US008558655B1

(12) United States Patent
Chen et al.

(10) Patent No.: US 8,558,655 B1
(45) Date of Patent: Oct. 15, 2013

(54) POSITIVE TEMPERATURE COEFFICIENT POLYMER COMPOSITION AND POSITIVE TEMPERATURE COEFFICIENT CIRCUIT PROTECTION DEVICE

(75) Inventors: Jack Jih-Sang Chen, Taipei (TW); Chang-Hung Jiang, Taipei (TW)

(73) Assignee: Fuzetec Technology Co., Ltd., New Taipei (TW)

( * ) Notice: Subject to any disclaimer, the term of this patent is extended or adjusted under 35 U.S.C. 154(b) by 0 days.

(21) Appl. No.: 13/541,040

(22) Filed: Jul. 3, 2012

(51) Int. Cl.
*H01C 7/10* (2006.01)

(52) U.S. Cl.
USPC ..... 338/22 R; 338/13

(58) Field of Classification Search
USPC ..... 338/22 R; 252/512, 513
See application file for complete search history.

(56) References Cited

U.S. PATENT DOCUMENTS

| | | | | |
|---|---|---|---|---|
| 6,362,721 | B1 * | 3/2002 | Chen et al. | 338/22 R |
| 6,452,476 | B1 * | 9/2002 | Handa | 338/22 R |
| 6,512,446 | B2 * | 1/2003 | Wang et al. | 338/22 R |
| 6,607,679 | B2 * | 8/2003 | Handa et al. | 252/513 |
| 7,102,483 | B2 * | 9/2006 | Hwang et al. | 338/22 R |
| 8,198,975 | B2 * | 6/2012 | Sha et al. | 338/22 R |

* cited by examiner

*Primary Examiner* — Kyung Lee
(74) *Attorney, Agent, or Firm* — Foley & Lardner LLP

(57) ABSTRACT

A PTC polymer composition includes a polymer component, and an electrically conductive filler component including an electro-conductive metallic particulate, an electro-conductive ceramic particulate, and an electro-conductive carbon particulate. The weight ratio of the polymer component to the filler component ranges from 1:13~1:5.5. The weight of the metallic particulate is higher than that of the ceramic particulate, and the weight of the ceramic particulate is higher than that of the carbon particulate. The carbon particulate is present in an amount ranging from 2.8 wt % to 7.3 wt % based on the weight of the filler component.

12 Claims, 4 Drawing Sheets

POSITIVE TEMPERATURE COEFFICIENT POLYMER COMPOSITION AND POSITIVE TEMPERATURE COEFFICIENT CIRCUIT PROTECTION DEVICE

BACKGROUND OF THE INVENTION

1. Field of the Invention

The present invention relates to a positive temperature coefficient polymer composition and a positive temperature coefficient circuit protection device, and more particularly to a positive temperature coefficient polymer composition including an electrically conductive filler component including an electro-conductive metallic particulate, an electro-conductive ceramic particulate, and an electro-conductive carbon particulate.

2. Description of the Related Art

It is well known that a positive temperature coefficient device generally has a positive temperature coefficient effect and therefore can be used as a circuit protection device. The positive temperature coefficient device includes a PTC polymer layer and positive and negative electrodes that are formed on two opposite surfaces of the polymer layer. The PTC polymer layer includes a PTC polymer matrix having a crystalline phase region and an amorphous phase region, and an electrically conductive particulate filler that is dispersed in the amorphous phase region of the PTC polymer matrix and that is formed into a continuous conductive path for electrical conduction between the positive and negative electrodes. The PTC effect is a phenomenon that when the temperature of the PTC polymer matrix is raised to its melting point, crystals in the crystalline phase region start melting, which results in generation of a new amorphous phase region. As the new amorphous phase region is increased to an extent to merge into the original amorphous phase region, the conductive path of the electrically conductive particulate filler will become discontinuous and the resistance of the PTC polymer layer will be sharply increased, thereby resulting in an electrical disconnection between the positive and negative electrodes.

Since carbon black electro-conductive filler has low conductivity, it is not suitable for use in a circuit protection device that requires a higher conductivity (low resistance). Although the conductivity of the positive temperature coefficient device may be increased (i.e., the volume resistivity can be decreased from 1.0 ohm-cm or more to less than 0.05 ohm-cm) by means of adding a non-carbon electro-conductive particulate filler having a high conductivity (for example, metal particulates, electro-conductive ceramic particulates and surface moralized particulates, etc.), the resultant positive temperature coefficient device has an unstable electrical characteristic property and its electrical characteristic is liable to deteriorate after a long period of use or storage.

U.S. Patent Application Publication No. 2008/0142494 discloses a positive temperature coefficient composition for making a heated seat. The positive temperature coefficient composition includes 5 to 70 wt % of an organic polymer and 30 to 95% of an electrically conductive filler, and preferably includes 15 to 60 wt % of the organic polymer and 40 to 90% of the electrically conductive filler. The electrically conductive filler includes 10 to 100 wt % of an electro-conductive ceramic filler and 15 to 90 wt % of a metal powder, and preferably includes 40 to 65 wt % of the electro-conductive ceramic filler and 35 to 60 wt % of the metal powder. The electrically conductive filler may include additionally 0.01 to 15 wt % of an electro-conductive carbonaceous filler, and preferably includes 1 to 10 wt % of the electro-conductive carbonaceous filler. A positive temperature coefficient material made from the positive temperature coefficient composition has a function of self-controlling and adjusting the seat temperature, which overcomes the overheating problem caused by a conventional heater and which eliminates the need for a temperature controller.

The abovementioned positive temperature coefficient composition is used as a heater for the heated seat, so that the temperature of the heated seat can be controlled automatically to be within a range that is comfortable for a person. When the temperature of the positive temperature coefficient composition exceeds a trip temperature, the resistance of the positive temperature coefficient composition will increase rapidly, causing the current to be almost zero and resulting in a power-off and non-heating state. On the other hand, when the temperature of the positive temperature coefficient material is less than the trip temperature, the current may flow and then a heating process may be performed again.

The abovementioned positive temperature coefficient composition serves as a heater and its material composition is formulated depending on the desired trip temperature. However, there is no teaching about how the positive temperature coefficient composition is formulated to obtain a highly electrically stable positive temperature coefficient material so as to serve as a circuit protection device. In consideration of application in a circuit protection device, the positive temperature coefficient material must have a high electrical stability to protect the downstream electronic components from burning out. Therefore, it is desired to produce a circuit protection device having high conductivity and electrical stability.

SUMMARY OF THE INVENTION

According to one aspect of this invention, there is provided a positive temperature coefficient polymer composition, which comprises:

a polymer component; and an electrically conductive filler component including an electro-conductive metallic particulate, an electro-conductive ceramic particulate, and an electro-conductive carbon particulate;

wherein the weight ratio of the polymer component to the electrically conductive filler component ranges from 1:13~1:5.5, wherein the weight of the electro-conductive metallic particulate is higher than that of the electro-conductive ceramic particulate, and the weight of the electro-conductive ceramic particulate is higher than that of the electro-conductive carbon particulate, wherein the electro-conductive carbon particulate is present in an amount ranging from 2.8 wt % to 7.3 wt % based on the weight of the electrically conductive filler component.

According to another aspect of this invention, there is provided a PTC circuit protection device, comprising:

a positive temperature coefficient layer made from the aforesaid positive temperature coefficient polymer composition; and two electrodes disposed on two opposite surfaces of the positive temperature coefficient layer.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
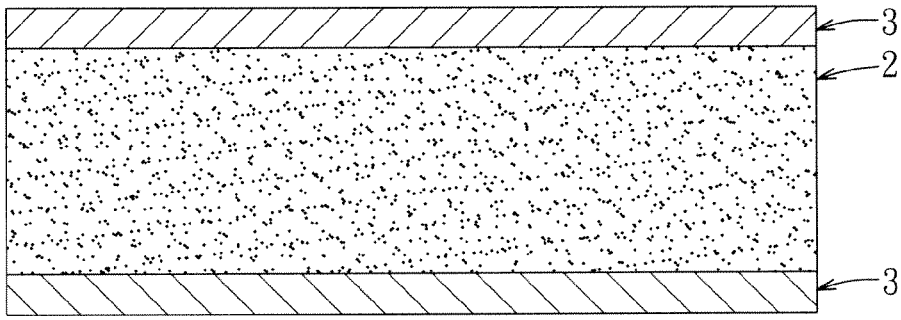
FIG. 1 is a schematic diagram of the preferred embodiment of a positive temperature coefficient circuit protection device according to the present invention.

Referring to FIG. 1, the preferred embodiment of a positive temperature coefficient circuit protection device of the present invention comprises a positive temperature coefficient layer 2 and two electrodes 3 respectively disposed on two opposite surfaces of the positive temperature coefficient layer 2. Preferably, the positive temperature coefficient layer 2 has a volume resistivity of about 0.05 ohm-cm or less. The positive temperature coefficient layer 2 includes a positive temperature coefficient polymer composition. The positive temperature coefficient polymer composition comprises a polymer component and an electrically conductive filler component. The electrically conductive filler component includes an electro-conductive metallic particulate, an electro-conductive ceramic particulate, and an electro-conductive carbon particulate. The weight ratio of the polymer component to the electrically conductive filler component ranges from 1:13~1:5.5, more preferably from 1:11.5 to 1:6.1. The weight of the electro-conductive metallic particulate is higher than that of the electro-conductive ceramic particulate, and the weight of the electro-conductive ceramic particulate is higher than that of the electro-conductive carbon particulate.

Preferably, based on the weight of the electrically conductive filler component, the electro-conductive carbon particulate is present in an amount ranging from 2.8 wt % to 7.3 wt %, the electro-conductive metallic particulate is present in an amount ranging from 56 wt % to 90 wt % and the electro-conductive ceramic particulate is present in an amount ranging from 7.0 wt % to 40 wt %. More preferably, based on the weight of the electrically conductive filler component, the electro-conductive carbon particulate is present in an amount ranging from 3.4 wt % to 6.8 wt %, the electro-conductive metallic particulate is present in an amount ranging from 59.6 wt % to 85.4 wt %, and the electro-conductive ceramic particulate is present in an amount ranging from 11.2 wt % to 33.7 wt %.

Preferably, the electro-conductive metallic particulate has a spherical shape, and the electro-conductive ceramic particulate is in a flake form. The electro-conductive carbon particulate has a ratio of dibutyl phthalate (DBP) absorption number to particle size ranging from 0.1 to 3.0.

Preferably, the electro-conductive metallic particulate is selected from the group consisting of metal particulate, surface-treated metal particulate, alloy particulate, surface metalized particulate, and combinations thereof. Examples of the electro-conductive metallic particulate include gold, silver, copper, aluminum, nickel powder, a glass bead metalized with nickel, a graphite metalized with nickel, a titanium tantalum solid solution, tungsten titanium tantalum chromium solid solution, tungsten tantalum solid solution, tungsten titanium tantalum niobium solid solution, tungsten titanium tantalum solid solution, tungsten titanium solid solution, and tantalum niobium solid solution. In examples of this invention, the electro-conductive metallic particulate is nickel powder.

Preferably, the electro-conductive ceramic particulate is made from a material selected from the group consisting of electro-conductive oxide, electro-conductive carbide, electro-conductive nitride, electro-conductive boride, electro-conductive sulfide, electro-conductive silicide, and combinations thereof. Examples of the electro-conductive ceramic particulate include titanium carbide, zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, and tungsten disilicide. In examples of this invention, the electro-conductive ceramic particulate is titanium carbide.

Preferably, the electro-conductive carbon particulate is made from a material selected from the group consisting of carbon black, graphite, carbon fiber, and combinations thereof. In examples of this invention, the electro-conductive carbon particulate is carbon black.

Preferably, the polymer component includes non-grafted polyolefin. The polymer component further includes an unsaturated carboxylic acid grafted polyolefin. The polyolefin and the unsaturated carboxylic acid grafted polyolefin are melted, blended and then cured to form a polymer matrix.

Preferably, the non-grafted polyolefin has a weight average molecular weight ranging from 50,000 g/mole to 300,000 g/mole.

Preferably, the non-grafted polyolefin is a non-grafted high density polyethylene, and the unsaturated carboxylic acid grafted polyolefin is an unsaturated carboxylic acid grafted high density polyethylene.

This invention also provides a PTC circuit protection device that includes a positive temperature coefficient layer made from the positive temperature coefficient polymer composition of this invention and two electrodes disposed on two opposite surfaces of the positive temperature coefficient layer.

The following examples and comparative examples are provided to illustrate the preferred embodiments of the invention, and should not be construed as limiting the scope of the invention.

Example 1

(E1)

9.63 g of high density polyethylene (HDPE), 9.63 g of unsaturated carboxylic acid grafted high density polyethylene (G-HDPE), 5.25 g of carbon black (trade name: Raven 430UB, DBP/D=0.95, bulk density=0.53 g/cm$^3$, electrical conductivity=$2.86\times10^4 m^{-1}\Omega^{-1}$, commercially available from Columbian Chemicals Company), 133 g of nickel powder (trade name: Ni-124, spherical shape, density=8.9 g/cm$^3$, electrical conductivity=$1430\times10^4 m^{-1}\Omega^{-1}$, commercially available from Atlantic Equipment Engineers), and 17.5 g titanium carbide (flakes, density=4.92 g/cm$^3$, residual oxygen content=0.4%, initial oxidation temperature=450° C., electrical conductivity=$164\times10^4 m^{-1}\Omega^{-1}$) were blended in a Brabender blender. The blending temperature was 200° C., the mixing rate was 60 rpm, and the blending time was 10 minutes. The blended mixture was placed in a mold, and was then heated and pressed using a hot press machine to form a positive temperature coefficient (PTC) layer having a thickness of 0.28 mm. The hot press temperature was 200° C., the hot press time was 4 minutes, and the hot press pressure was 80 kg/cm$^2$. Thereafter, each side of the positive temperature coefficient layer was coated with a nickel plated copper foil, followed by a hot pressing procedure under the same conditions as that performed information of the positive temperature coefficient layer, thereby obtaining a sandwich structure. The sandwich structure was cut into PTC elements each of which has a size of 4.5 mm×3.2 mm. The weight percentage of each of the components of the positive temperature coefficient layer based on the total weight of the positive temperature coefficient layer and the measured resistance and volume resistivity of the PTC element in Example 1 are listed in Table 1. The weight ratio (P:F) of the polymer component to the electrically conductive filler component of Example 1, and the weight percent of the electro-conductive carbon particulate, the electro-conductive metallic particulate and the electro-conductive ceramic particulate based on the weight of the electrically conductive filler component are listed in Table 2.

TABLE 1

| | HDPE (%) | G-HDPE (%) | Ni powder (%) | TiC* (%) | CB# (%) | Resistance (ohm) | Volume resistivity (ohm-cm) |
|---|---|---|---|---|---|---|---|
| E1 | 5.5 | 5.5 | 76 | 10 | 3 | 0.0099 | 0.0407 |
| E2 | 5.5 | 5.5 | 74 | 10 | 5 | 0.0103 | 0.0424 |
| E3 | 5.5 | 5.5 | 73 | 10 | 6 | 0.0109 | 0.0448 |
| E4 | 5.5 | 5.5 | 56 | 30 | 3 | 0.0118 | 0.0485 |
| E5 | 5.5 | 5.5 | 54 | 30 | 5 | 0.0120 | 0.0494 |
| E6 | 5.5 | 5.5 | 53 | 30 | 6 | 0.0122 | 0.0502 |
| E7 | 4 | 4 | 57 | 30 | 5 | 0.0089 | 0.0366 |
| E8 | 7 | 7 | 70 | 10 | 6 | 0.0121 | 0.0498 |
| CE1 | 6 | 6 | 88 | 0 | 0 | 0.0095 | 0.0391 |
| CE2 | 5 | 5 | 0 | 90 | 0 | 0.0131 | 0.0539 |
| CE3 | 6 | 6 | 78 | 10 | 0 | 0.0098 | 0.0403 |
| CE4 | 6 | 6 | 58 | 30 | 0 | 0.0123 | 0.0506 |
| CE5 | 6 | 6 | 48 | 40 | 0 | 0.0199 | 0.0819 |
| CE6 | 5.5 | 5.5 | 88 | 0 | 1 | 0.0101 | 0.0416 |
| CE7 | 5 | 5 | 85 | 0 | 5 | 0.0115 | 0.0473 |
| CE8 | 5 | 5 | 0 | 89 | 1 | 0.0125 | 0.0514 |
| CE9 | 5 | 5 | 0 | 85 | 5 | 0.0144 | 0.0592 |
| CE10 | 5.5 | 5.5 | 78 | 10 | 1 | 0.0093 | 0.0383 |
| CE11 | 5.5 | 5.5 | 77 | 10 | 2 | 0.0094 | 0.0387 |
| CE12 | 5.5 | 5.5 | 72 | 10 | 7 | 0.0115 | 0.0473 |
| CE13 | 5.5 | 5.5 | 69 | 10 | 10 | 0.0119 | 0.0490 |
| CE14 | 5.5 | 5.5 | 58 | 30 | 1 | 0.0110 | 0.0453 |
| CE15 | 5.5 | 5.5 | 57 | 30 | 2 | 0.0116 | 0.0477 |
| CE16 | 5.5 | 5.5 | 52 | 30 | 7 | 0.0125 | 0.0514 |
| CE17 | 5 | 5 | 50 | 30 | 10 | 0.0131 | 0.0539 |

*TiC represents titanium carbide
#CB represents carbon black

TABLE 2

| | Weight percent based on the weight of the PTC layer | | | Weight percent based on the weight of the filler component | | |
|---|---|---|---|---|---|---|
| | Polymer component (P) (wt %) | Filler component (F) (wt %) | Ratio (P:F) | Ni powder Wt % | TiC* Wt % | CB# Wt % |
| E1 | 11 | 89 | 1:8 | 85.39 | 11.24 | 3.37 |
| E2 | 11 | 89 | 1:8 | 83.15 | 11.24 | 5.62 |
| E3 | 11 | 89 | 1:8 | 82.02 | 11.24 | 6.74 |
| E4 | 11 | 89 | 1:8 | 62.92 | 33.71 | 3.37 |
| E5 | 11 | 89 | 1:8 | 60.67 | 33.71 | 5.62 |
| E6 | 11 | 89 | 1:8 | 59.55 | 33.71 | 6.74 |
| E7 | 8 | 92 | 1:11.5 | 61.96 | 32.61 | 5.43 |

TABLE 2-continued

| | Weight percent based on the weight of the PTC layer | | | Weight percent based on the weight of the filler component | | |
|---|---|---|---|---|---|---|
| | Polymer component (P) (wt %) | Filler component (F) (wt %) | Ratio (P:F) | Ni powder Wt % | TiC* Wt % | CB# Wt % |
| E8 | 14 | 86 | 1:6.1 | 81.40 | 11.63 | 6.98 |
| CE10 | 11 | 89 | 1:8 | 87.64 | 11.24 | 1.12 |
| CE11 | 11 | 89 | 1:8 | 86.52 | 11.24 | 2.25 |
| CE12 | 11 | 89 | 1:8 | 80.90 | 11.24 | 7.87 |
| CE13 | 11 | 89 | 1:8 | 77.53 | 11.24 | 11.24 |
| CE14 | 11 | 89 | 1:8 | 65.17 | 33.71 | 1.12 |
| CE15 | 11 | 89 | 1:8 | 64.04 | 33.71 | 2.25 |
| CE16 | 11 | 89 | 1:8 | 58.43 | 33.71 | 7.87 |
| CE17 | 10 | 90 | 1:9 | 55.56 | 33.33 | 11.11 |

*TiC represents titanium carbide
#CB represents carbon black

Examples 2-8

(E2-E8)

The preparation processes and conditions of Examples 2-8 were the same as those of Example 1 except for the amounts of the components of the positive temperature coefficient layer (see Tables 1 and 2). The test resistance and volume resistivity of a PTC element in each of E2 to E8 are listed in Table 1.

Comparative Examples 1-17

(CE1-CE17)

The preparation processes and conditions of comparative examples 1-17 were the same as those of Example 1 except for the amounts of the components of the positive temperature coefficient layer (see Tables 1 and 2). The test resistance and volume resistivity of a PTC element in each of CE1 to CE17 are listed in Table 1.

Test

Endurance Test

Figure 2:
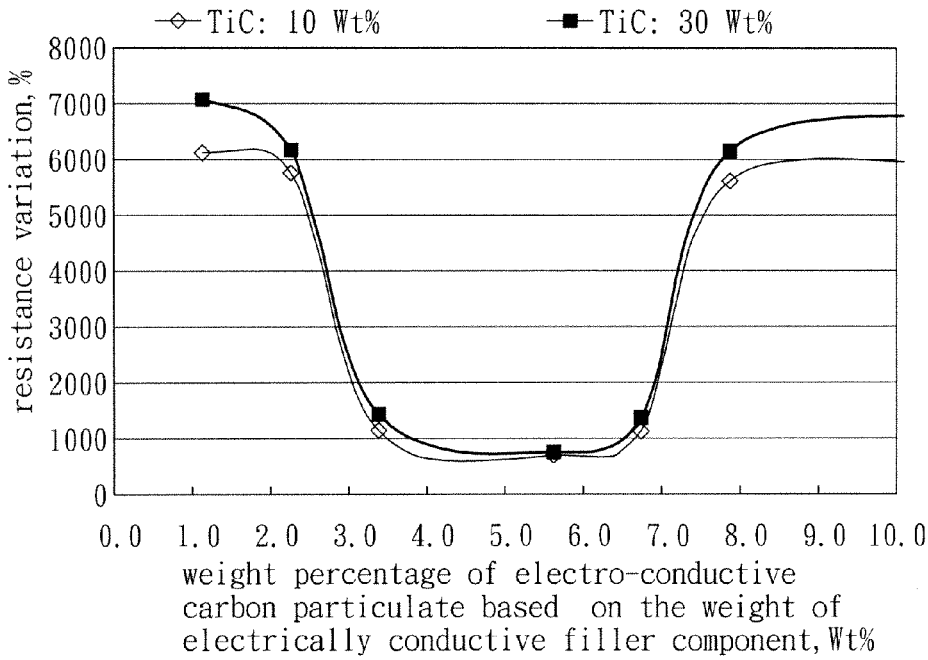
FIG. 2 illustrates the relationship between the resistance variation and the content of an electro-conductive carbon particulate in an endurance test for examples and comparative examples.

The PTC elements of E1-E8 and CE1-CE17 were subjected to an endurance test under the conditions of 6 Vdc/100 A、16 Vdc/100 A or 32 Vdc/100 A, and in a power-on state for 60 seconds and in a power-off state for 60 seconds for 720 cycles. In each of examples and comparative examples, 10 PTC elements were used to perform the endurance test in each condition, and the resistance variation between the resistance after test (Rf) and resistance before test (Ri) and pass rate of the PTC elements (number of the PTC elements that pass the endurance test/10 PTC elements) were recorded and the results are shown in Table 3. It is seen from Table 3 that the resistance variation of E1-E8 is superior to that of CE10-CE17. The endurance test results of E1-E6 (E1-E3 contain 10 wt % of TiC, and E4-E6 contain 30 wt % of TiC) and CE10-CE12 (containing 10 wt % of TiC) and CE14-CE16 (containing 30 wt % of TiC) are further shown in FIG. 2. It is seen from FIG. 2 that the positive temperature coefficient layer containing 3.4 wt %-6.8 wt % of electro-conductive carbon particulate (based on the weight of the electrically conductive filler component) has an unexpected superiority in resistance variation.

TABLE 3

| | 6 Vdc/100 A, 720 cycle test | | 16 Vdc/100 A, 720 cycle test | | 32 Vdc/100 A, 720 cycle test | |
|---|---|---|---|---|---|---|
| | Rf/Ri avg, % | Pass rate % | Rf/Ri avg, % | Pass rate % | Rf/Ri avg, % | Pass rate % |
| E 1 | 945% | 100% | 1011% | 100% | 1125% | 100% |
| E 2 | 523% | 100% | 821% | 100% | 685% | 100% |
| E 3 | 875% | 100% | 998% | 100% | 1138% | 100% |
| E 4 | 978% | 100% | 1187% | 100% | 1431% | 100% |
| E 5 | 330% | 100% | 419% | 100% | 746% | 100% |
| E 6 | 787% | 100% | 989% | 100% | 1354% | 100% |
| E 7 | 670% | 100% | 850% | 100% | 1513% | 90% |
| E 8 | 783% | 100% | 994% | 100% | 1469% | 100% |
| CE1 | n/a | 0% | n/a | 0% | n/a | 0% |
| CE2 | 25953% | 100% | 49231% | 40% | n/a | 0% |
| CE3 | n/a | 0% | n/a | 0% | n/a | 0% |
| CE4 | 11227% | 100% | n/a | 0% | n/a | 0% |
| CE5 | 10219% | 100% | n/a | 0% | n/a | 0% |
| CE6 | n/a | 0% | n/a | 0% | n/a | 0% |
| CE7 | n/a | 0% | n/a | 0% | n/a | 0% |
| CE8 | 22747% | 100% | 44206% | 60% | n/a | 0% |
| CE9 | 21196% | 100% | 44431% | 60% | n/a | 0% |
| CE10 | 1909% | 100% | 3544% | 80% | 6100% | 20% |
| CE11 | 1886% | 100% | 3312% | 80% | 5776% | 50% |
| CE12 | 1777% | 100% | 2788% | 90% | 5590% | 70% |
| CE13 | 1811% | 100% | 3010% | 80% | 5889% | 60% |
| CE14 | 3109% | 100% | 4311% | 100% | 7103% | 40% |
| CE15 | 2980% | 100% | 3978% | 100% | 6150% | 60% |
| CE16 | 2555% | 100% | 3133% | 90% | 6123% | 50% |
| CE17 | 2712% | 100% | 3788% | 80% | 6831% | 30% |

n/a indicated not available

Aging Test

Figure 3:
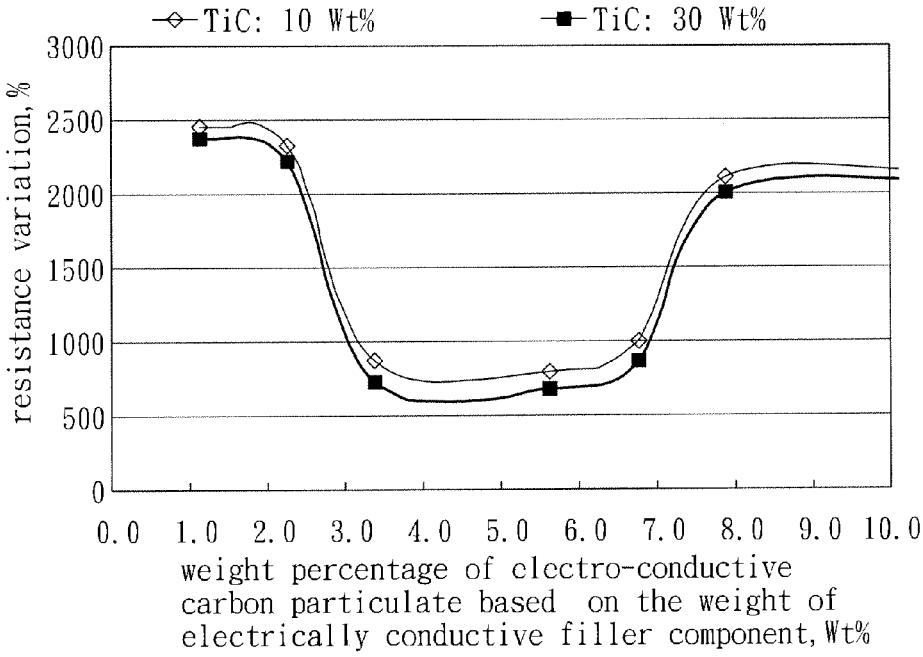
FIG. 3 illustrates the relationship between the resistance variation and the content of an electro-conductive carbon particulate in an aging test for examples and comparative examples.

An aging test was conducted on the PTC elements of E1-E8 and CE1-CE17 under the conditions of 6 Vdc/100 A、16 Vdc/100 A and 32 Vdc/100 A, and in a continuously power-on state for 72 hours. 10 PTC elements were tested for each of the examples or comparative examples in each condition, and the resistance variation of the resistance after test (Rf)/resistance before test (Ri) and the pass rate (number of the PTC elements that pass the endurance test/10 PTC elements) were recorded and were used as evaluations for aging resistance. Results are shown in Table 4. It is seen from Table 4 that the aging resistance of E1-E8 is superior to that of CE10-CE17. The aging test results of E1-E6 and CE10-CE12 and CE14-CE16 are further shown in FIG. 3. It is seen from FIG. 3 that the positive temperature coefficient layer containing 3.4 wt %-6.8 wt % of electro-conductive carbon particulate (based on the weight of the electrically conductive filler component) has an unexpected superiority in aging resistance.

TABLE 4

| | 6 Vdc/100 A, 72 hrs | | 16 Vdc/100 A, 72 hrs | | 32 Vdc/100 A, 72 hrs | |
|---|---|---|---|---|---|---|
| | Rf/Ri avg, % | Pass rate % | Rf/Ri avg, % | Pass rate % | Rf/Ri avg, % | Pass rate % |
| E1 | 389% | 100% | 623% | 100% | 867% | 100% |
| E2 | 344% | 100% | 579% | 100% | 798% | 100% |
| E3 | 376% | 100% | 602% | 100% | 1001% | 100% |
| E4 | 357% | 100% | 588% | 100% | 725% | 100% |
| E5 | 305% | 100% | 519% | 100% | 666% | 100% |
| E6 | 368% | 100% | 611% | 100% | 854% | 100% |
| E7 | 333% | 100% | 532% | 100% | 723% | 90% |
| E8 | 389% | 100% | 622% | 100% | 845% | 100% |
| CE1 | 1954% | 80% | n/a | 0% | n/a | 0% |
| CE2 | 277% | 100% | 330% | 100% | n/a | 0% |
| CE3 | 4966% | 100% | 8334% | 40% | n/a | 0% |
| CE4 | 12957% | 100% | 14971% | 60% | n/a | 0% |
| CE5 | 12916% | 100% | 17040% | 60% | n/a | 0% |
| CE6 | 3301% | 90% | n/a | 0% | n/a | 0% |

TABLE 4-continued

| | 6 Vdc/100 A, 72 hrs | | 16 Vdc/100 A, 72 hrs | | 32 Vdc/100 A, 72 hrs | |
|---|---|---|---|---|---|---|
| | Rf/Ri avg, % | Pass rate % | Rf/Ri avg, % | Pass rate % | Rf/Ri avg, % | Pass rate % |
| CE7 | 3166% | 100% | n/a | 0% | n/a | 0% |
| CE8 | 245% | 100% | 299% | 100% | n/a | 0% |
| CE9 | 227% | 100% | 303% | 100% | n/a | 0% |
| CE10 | 974% | 100% | 1533% | 50% | 2443% | 20% |
| CE11 | 913% | 100% | 1434% | 80% | 2331% | 30% |
| CE12 | 878% | 100% | 1223% | 90% | 2099% | 60% |
| CE13 | 897% | 100% | 1313% | 90% | 2107% | 60% |
| CE14 | 891% | 100% | 1335% | 90% | 2376% | 40% |
| CE15 | 812% | 100% | 1243% | 90% | 2218% | 50% |
| CE16 | 775% | 100% | 1058% | 90% | 1998% | 70% |
| CE17 | 803% | 100% | 1144% | 90% | 2076% | 50% |

n/a indicated not available

Thermal Runaway Test

Figure 4:
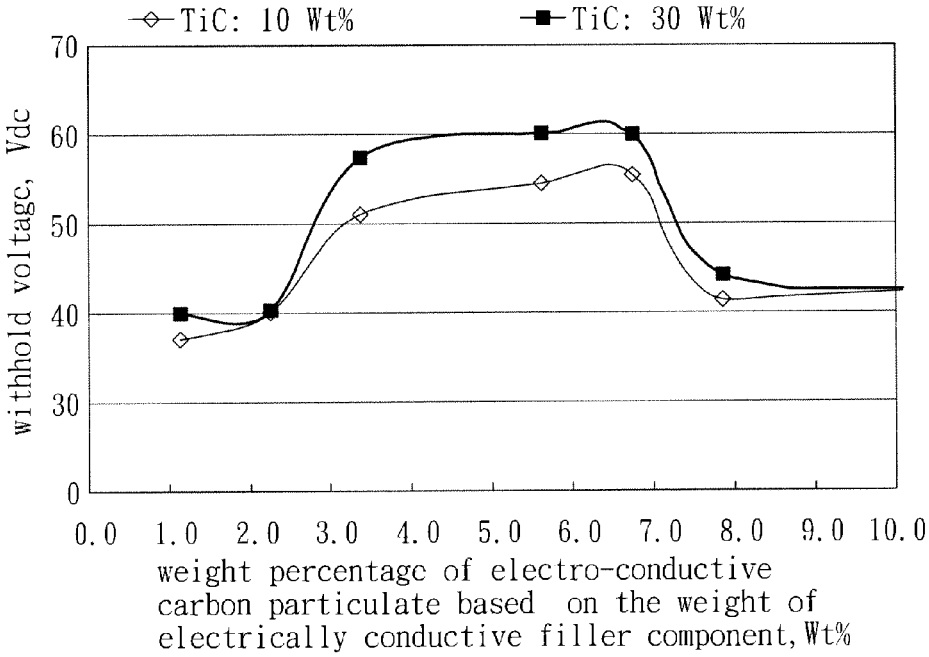
FIG. 4 illustrates the relationship between the withstand voltage and the content of an electro-conductive carbon particulate in a thermal runaway test for examples and comparative examples.

A thermal runaway test was conducted on E1-E8 and CE1-CE17, and the testing conditions were as follows: an external direct current voltage was increased stepwise from an initial voltage of 6 Vdc to a final voltage of 60 Vdc at a fixed current of 100 A; the fixed current was sufficient to enable the PTC elements to be tripped at the initial voltage (6 Vdc); the external voltage was increased stepwise by a 6 Vdc increment for each incremental stage; and the duration time for each incremental stage was 2 minutes. 10 PTC elements were tested for each of the examples or comparative examples. The withstand voltage at which the PTC element was burned out was recorded and the results are shown in Table 5. The thermal runaway test results for E1-E6, CE10-CE12 and CE14-CE16 are further shown in FIG. 4. It is seen from FIG. 4 that the positive temperature coefficient layer containing 3.4 wt %-6.8 wt % of electro-conductive carbon particulate (based on the weight of the electrically conductive filler component) has an unexpected superiority in withstand voltage.

TABLE 5

| | Maximum withstand voltage (Vdc) |
|---|---|
| E1 | 50.9 |
| E2 | 54.4 |
| E3 | 55.5 |
| E4 | 57.4 |
| E5 | 60.0 |
| E6 | 59.8 |
| E7 | 59.2 |
| E8 | 57.4 |
| CE1 | 21.4 |
| CE2 | 29.2 |
| CE3 | 23.4 |
| CE4 | 27.6 |
| CE5 | 28.2 |
| CE6 | 22.2 |
| CE7 | 25.4 |
| CE8 | 29.4 |
| CE9 | 29.8 |
| CE10 | 36.8 |
| CE11 | 39.9 |
| CE12 | 41.1 |
| CE13 | 42.2 |
| CE14 | 39.8 |
| CE15 | 40.1 |
| CE16 | 44.1 |
| CE17 | 42.2 |

To sum up, by virtue of mixing the electro-conductive metallic particulate, the electro-conductive ceramic particulate, and the electro-conductive carbon particulate to form the electrically conductive filler component and by limiting the weight percent of the electro-conductive carbon particulate, the electrical stability and the service life of the PTC element can be enhanced.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A positive temperature coefficient polymer composition, comprising:

a polymer component; and an electrically conductive filler component including an electro-conductive metallic particulate, an electro-conductive ceramic particulate, and an electro-conductive carbon particulate;

wherein the weight ratio of said polymer component to said electrically conductive filler component ranges from 1:13 to 1:5.5, wherein the weight of said electro-conductive metallic particulate is higher than that of said electro-conductive ceramic particulate, and the weight of said electro-conductive ceramic particulate is higher than that of said electro-conductive carbon particulate, and wherein, based on the weight of said electrically conductive filler component, said electro-conductive carbon particulate is present in an amount ranging from 3.4 wt % to 6.8 wt %, said electro-conductive metallic particulate is present in an amount ranging from 59.6 wt % to 85.4 wt %, and said electro-conductive ceramic particulate is present in an amount ranging from 11.2 wt % to 33.7 wt %.

2. The positive temperature coefficient polymer composition of claim 1, wherein the weight ratio of said polymer component to said electrically conductive filler component ranges from 1:11.5 to 1:6.1.

3. The positive temperature coefficient polymer composition of claim 1, wherein said electro-conductive metallic particulate has a spherical shape, and said electro-conductive ceramic particulate is in a flake form.

4. The positive temperature coefficient polymer composition of claim 1, wherein said electro-conductive carbon particulate has a ratio of dibutyl phthalate (DBP) absorption number to particle size ranging from 0.1 to 3.0.

5. The positive temperature coefficient polymer composition of claim 1, wherein said electro-conductive metallic particulate is selected from the group consisting of metal particulate, surface-treated metal particulate, alloy particulate, surface metalized particulate, and combinations thereof.

6. The positive temperature coefficient polymer composition of claim 5, wherein said electro-conductive metallic particulate is made from Ni.

7. The positive temperature coefficient polymer composition of claim 1, wherein said electro-conductive ceramic particulate is made from a material selected from the group consisting of electro-conductive oxide, electro-conductive carbide, electro-conductive nitride, electro-conductive boride, electro-conductive sulfide, electro-conductive silicide, and combinations thereof.

8. The positive temperature coefficient polymer composition of claim 7, wherein said electro-conductive ceramic particulate is made from titanium carbide.

9. The positive temperature coefficient polymer composition of claim 7, wherein said electro-conductive carbon particulate is made from a material selected from the group consisting of carbon black, graphite, and the combination thereof.

10. The positive temperature coefficient polymer composition of claim 9, wherein said electro-conductive carbon particulate is made from carbon black.

11. The positive temperature coefficient polymer composition of claim 1, wherein said polymer component includes polyolefin.

12. A PTC circuit protection device, comprising:

a positive temperature coefficient layer made from a positive temperature coefficient polymer composition of claim 1; and two electrodes disposed on two opposite surfaces of said positive temperature coefficient layer.

* * * * *